US011781386B2

(12) United States Patent
Abdollahi et al.

(10) Patent No.: US 11,781,386 B2
(45) **Date of Patent: *Oct. 10, 2023**

(54) TOOL FOR REMEDIAL OF LOST CIRCULATION WHILE DRILLING

(71) Applicant: TOPI AS, Trondheim (NO)

(72) Inventors: Jafar Abdollahi, Trondheim (NO); Inge Manfred Carlsen, Ranheim (NO)

(73) Assignee: TOPI AS, Trondheim (NO)

( * ) Notice: Subject to any disclaimer, the term of this patent is extended or adjusted under 35 U.S.C. 154(b) by 0 days.

This patent is subject to a terminal disclaimer.

(21) Appl. No.: 17/780,582

(22) PCT Filed: Nov. 30, 2020

(86) PCT No.: PCT/NO2020/050295

§ 371 (c)(1),
(2) Date: May 27, 2022

(87) PCT Pub. No.: WO2021/107786

PCT Pub. Date: Jun. 3, 2021

(65) Prior Publication Data

US 2023/0139705 A1 May 4, 2023

(30) Foreign Application Priority Data

Nov. 28, 2019 (NO) ..... 20191415

(51) Int. Cl.
*E21B 21/00* (2006.01)
*E21B 34/14* (2006.01)
(Continued)

(52) U.S. Cl.
CPC ..... *E21B 21/003* (2013.01); *E21B 21/103* (2013.01); *E21B 34/063* (2013.01);
(Continued)

(58) Field of Classification Search
CPC .... E21B 21/003; E21B 21/103; E21B 34/142; E21B 34/063; E21B 47/00; E21B 47/12; E21B 2200/06
See application file for complete search history.

(56) References Cited

U.S. PATENT DOCUMENTS 3,255,833 A 6/1966 Kerr
5,343,968 A * 9/1994 Glowka ..... E21B 33/138 175/215

(Continued)

FOREIGN PATENT DOCUMENTS

CN 104153738 A 11/2014
CN 107429544 A 12/2017

(Continued)

OTHER PUBLICATIONS

International Preliminary Report on Patentability, issued in PCT/NO2020/050295, dated Feb. 11, 2022.

(Continued)

*Primary Examiner* — Christopher J Sebesta
(74) *Attorney, Agent, or Firm* — Birch, Stewart, Kolasch & Birch, LLP

(57) ABSTRACT

A mud loss treatment drilling tool includes the tool having an upper tooljoint to a lower end of an above drill pipe string, one or more tanks with a through channel for a drilling fluid flow, a lower tooljoint connected to a BHA assembly at least comprising a drill bit; the tank arranged for holding a swellable sealant agent; the swellable sealant agent arranged for mixing with water to swell; the tank provided with an outlet to the through channel for the swellable sealant agent, so as for, when an undesired mud loss is detected, for flushing all or part of the swellable sealant agent into the through channel, so as for a mixture of the swellable agent and the water to start reacting to swell during the time it takes the mixture to reach a fracture (Continued)

*principle, outlet (120) to central bore (101)* extending from a well under drilling by said BHA, so as for continuing to swell and block the fracture to stop the undesired mud loss.

35 Claims, 11 Drawing Sheets

(51) Int. Cl.
*E21B 21/10* (2006.01)
*E21B 34/06* (2006.01)
*E21B 47/00* (2012.01)
*E21B 47/12* (2012.01)

(52) U.S. Cl.
CPC ..... *E21B 34/142* (2020.05); *E21B 47/00* (2013.01); *E21B 47/12* (2013.01); *E21B 2200/06* (2020.05)

(56) References Cited

U.S. PATENT DOCUMENTS 5,533,570 A * 7/1996 Streich ..... E21B 27/02 166/333.1
6,269,878 B1 8/2001 Wyatt et al.
8,047,298 B2 * 11/2011 Solhaug ..... E21B 33/1208 166/387
11,578,542 B2 * 2/2023 Abdollahi ..... E21B 47/10
2007/0246225 A1 10/2007 Hailey, Jr. et al.
2016/0201410 A1 7/2016 Zhou
2018/0340381 A1 11/2018 Zhou
2019/0249515 A1 8/2019 Al-Shammari
2020/0347686 A1 * 11/2020 Carisella ..... E21B 21/003

FOREIGN PATENT DOCUMENTS

EP 1 653 042 A1 5/2006
NO 20180753 A1 12/2019
WO WO 00/66878 A1 11/2000

OTHER PUBLICATIONS

International Search Report, issued in PCT/NO2020/050295, dated Mar. 22, 2021.
Norwegian Search Report, issued in Priority Application No. 20191415, dated May 14, 2020.
Written Opinion of the International Searching Authority, issued in PCT/NO2020/050295, dated Mar. 22, 2021.

* cited by examiner

*Fig. 1 - principle, outlet (120) to central bore (101)*

*Fig. 2: with drill collars*

*Fig. 3: dual pipe & subs*

*Fig. 4: ball seat obturator release*

*Fig. 5: gas drive charge*

*motor controlled*
*inlet valve 12*

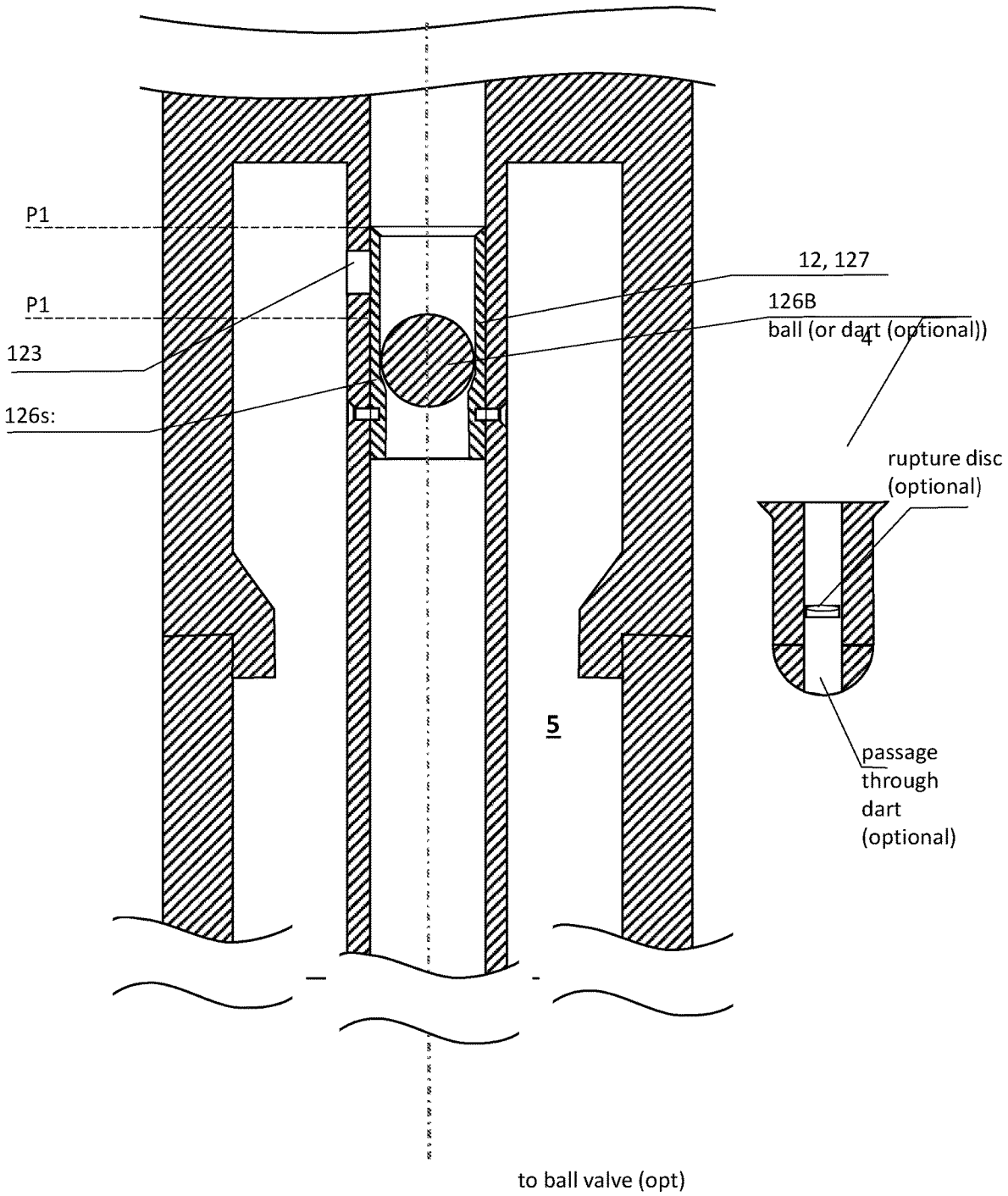
*Fig. 7: sliding sleeve ball seat valve*

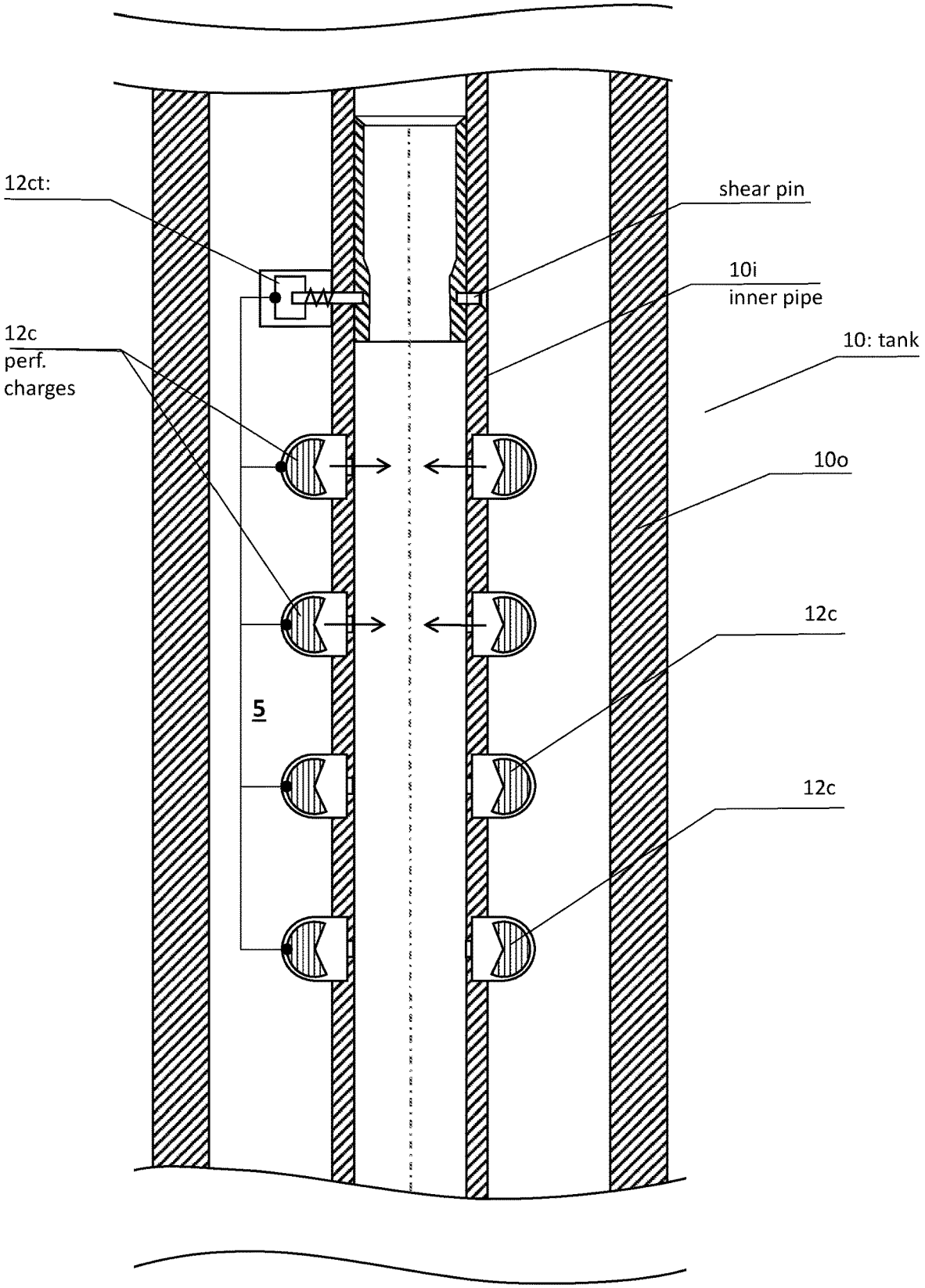
*Fig. 8: inverted perforation gun*

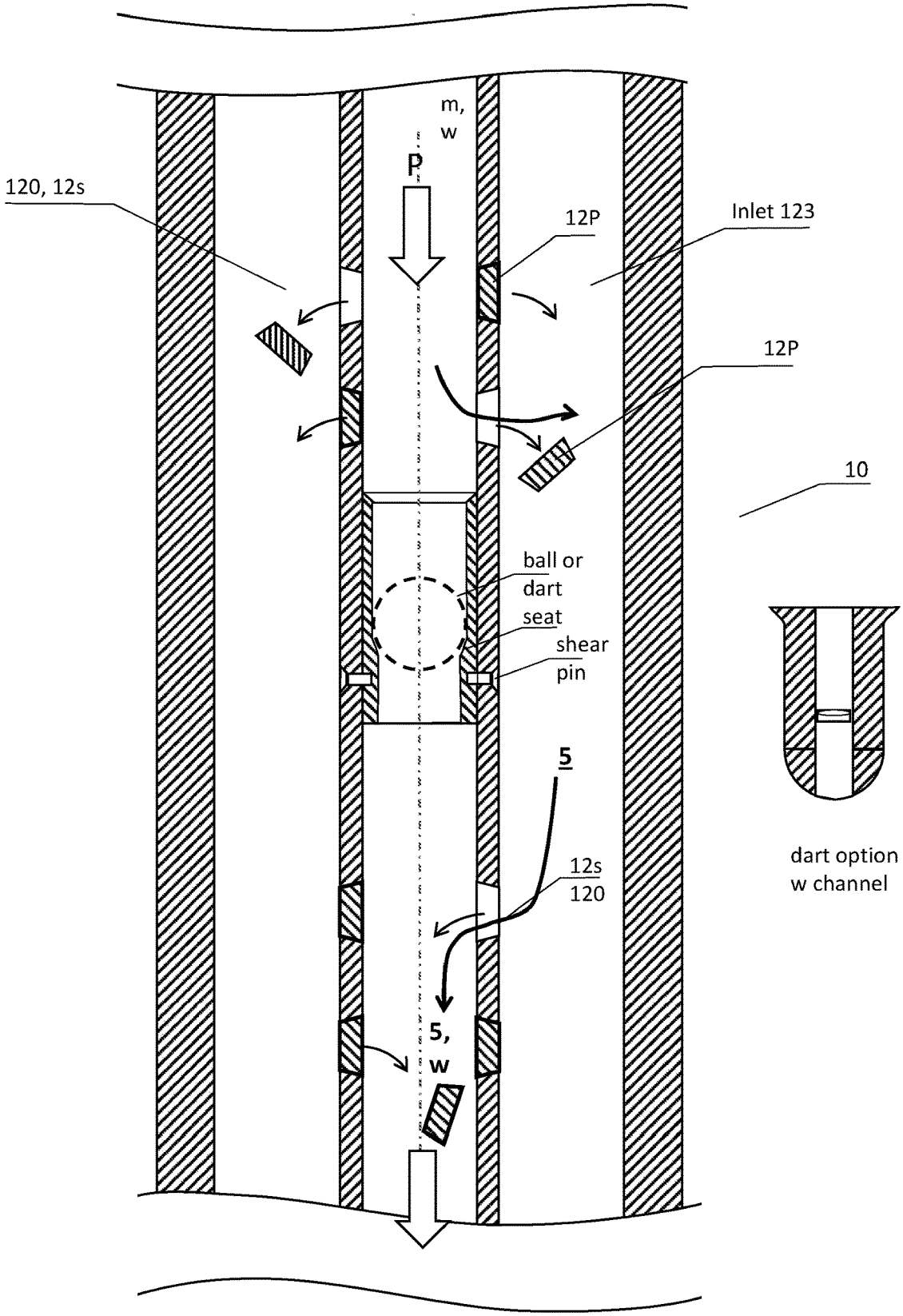
*Fig. 9: slotted pipe temporary plugs*

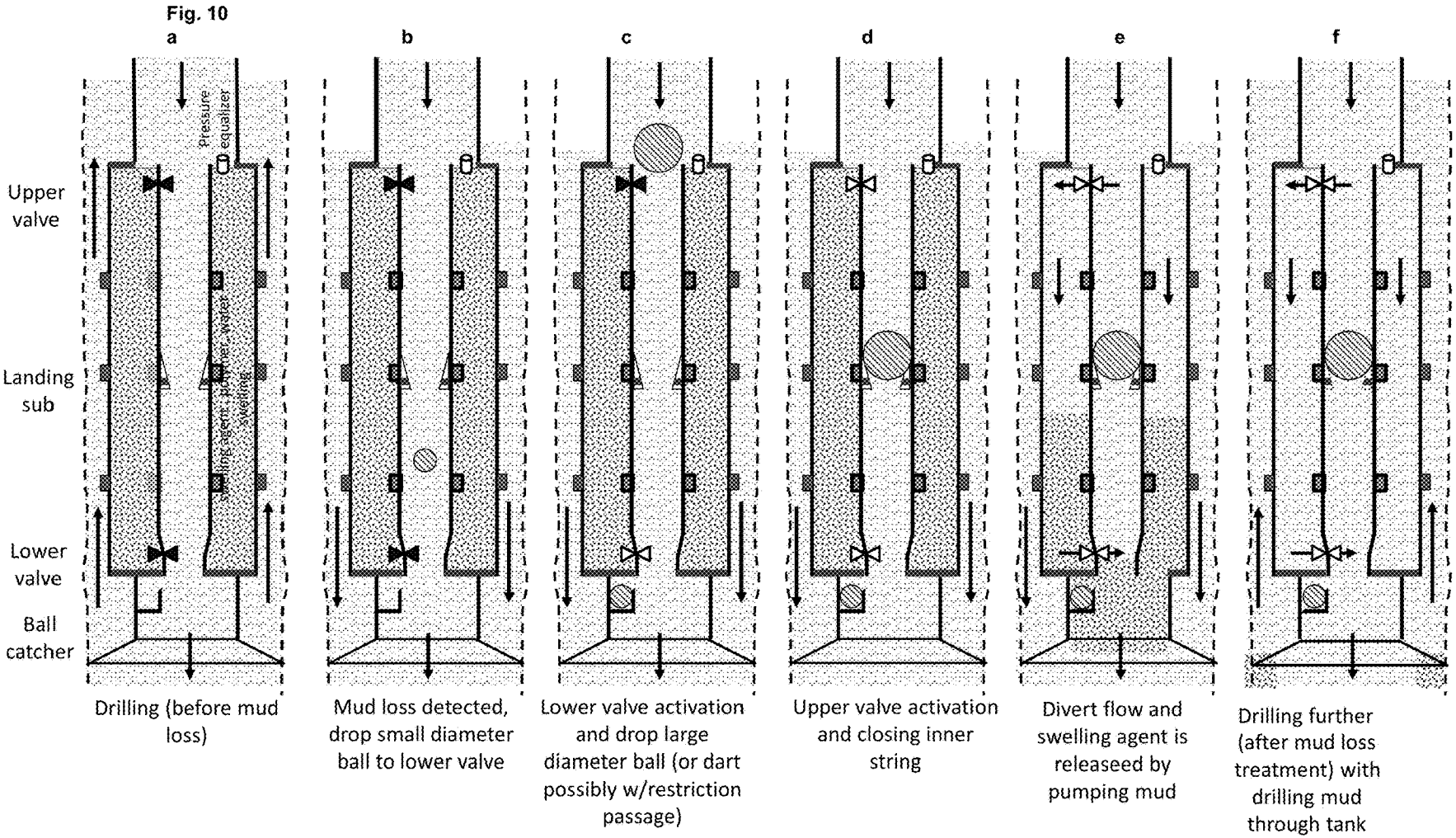
Fig. 10
a
b
c
d
e
f
Pressure equalizer
Swelling agent, polymer, water
Swelling
Upper valve
Landing sub
Lower valve
Ball catcher
Drilling (before mud loss)
Mud loss detected, drop small diameter ball to lower valve
Lower valve activation and drop large diameter ball (or dart possibly w/restriction passage)
Upper valve activation and closing inner string
Divert flow and swelling agent is releaseed by pumping mud
Drilling further (after mud loss treatment) with drilling mud through tank

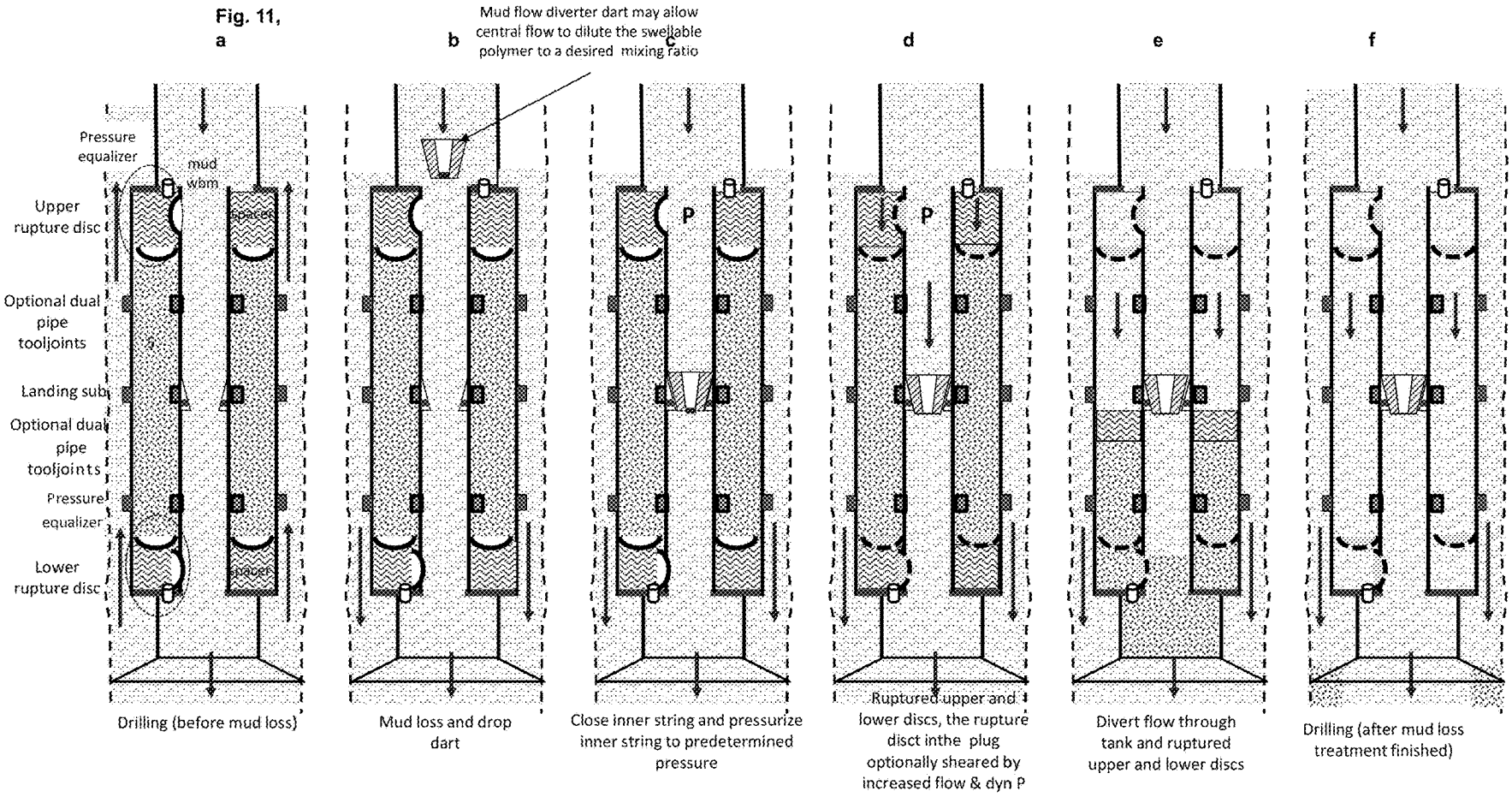
Fig. 11,
a
b
c
d
e
f
Pressure equalizer
mud
wbm
Upper rupture disc
Optional dual pipe tooljoints
Landing sub
Optional dual pipe tooljoints
Pressure equalizer
Lower rupture disc
Drilling (before mud loss)
Mud flow diverter dart may allow central flow to dilute the swellable polymer to a desired mixing ratio
Mud loss and drop dart
P
Close inner string and pressurize inner string to predetermined pressure
Ruptured upper and lower discs, the rupture disct inthe plug optionally sheared by increased flow & dyn P
Divert flow through tank and ruptured upper and lower discs
Drilling (after mud loss treatment finished)

TOOL FOR REMEDIAL OF LOST CIRCULATION WHILE DRILLING

INTRODUCTION

The present invention relates to a downhole lost circulation while drilling remedial tool. More specifically, it relates to a tool arranged for detecting an undesired mud loss state, and, if such mud loss state is determined, to release from a drill string conveyed tank above the bottomhole assembly, a fluid which starts reacting with ambient water such as water from the drilling mud or the formation, and when entering cracks and fissures causing the mud loss, the reacting fluid will continue to react with water and expand to form a gel-like substance which blocks the cracks and fissures.

A major problem when a mud loss is detected, is the time it takes to circulate in remedial agents to stop the loss of mud or lost circulation if one is drilling at several kilometers depth in a well. Another problem is to introduce a remedial fluid such as cement or swelling material from the surface, which is known practice, because it is difficult to control in advance the time the remedial fluid shall use to set and cure. The amount of pumped remedial fluid may be tens of cubic metres.

The main purpose of the invention is, during drilling, to detect an undesired mud loss state and release a swellable sealant agent from a downhole tank to near the drilling bit and let it mix with water and cure the fracture causing the undesired mud loss. In an embodiment of the invention the mud loss state is detected downhole and action is automatically taken.

BACKGROUND ART

The U.S. Pat. No. 3,255,833A from 1966 identifies a problem regarding loss of the return circulation drilling fluid through so-called blind holes, and discloses a device and method to apply a wall-building paste around the drill bit for rotary well-drilling apparatus. Norwegian patent application NO20180753 discloses a device and a method for releasing a swellable agent from a drill pipe string conveyed annular tank near the drill bit in order to remedy loss of circulation. Further background art is mentioned in EP1653042A1, WO00/66878A1, US2007/0246225A1 and EP1653942A1.

BRIEF SUMMARY OF THE INVENTION

The invention is defined in the attached claims.

BRIEF FIGURE CAPTIONS

Embodiments of the invention are illustrated in the attached drawing Figures.

Figure 6:
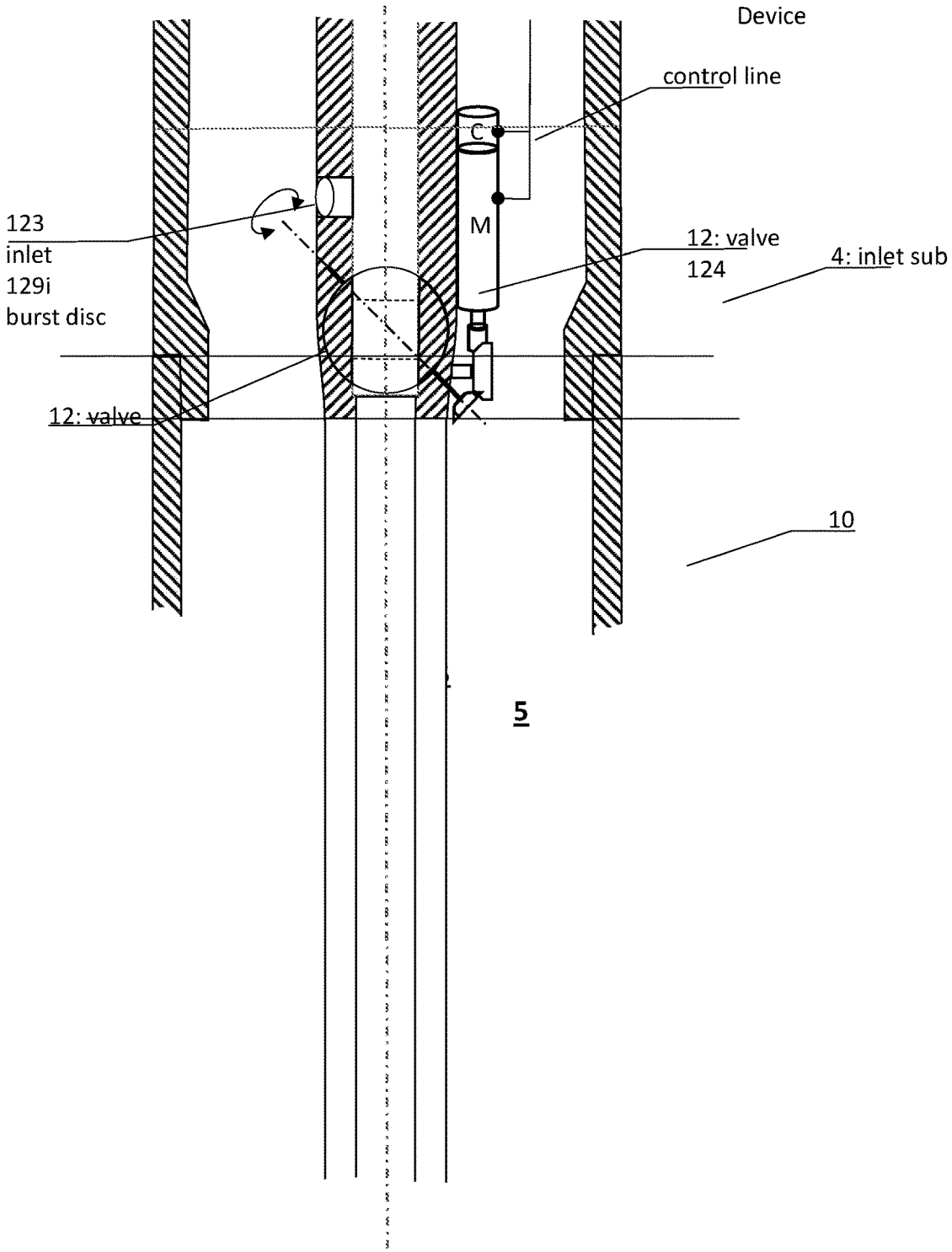

FIG. 6 illustrates an embodiment with a locally or remotely controlled motor-driven ball valve for closing or opening the through bore (101) of the upper diverter sub (4). We could also use downhole motor-released ball drop from an "inverse ball catcher" to enter obturator balls to block the centrial bore. When the central bore (101) is blocked a shown here, the upper burst disc may break and the drilling mud will force out the swelling agent (5) from the lower outlet aperture (120).

FIG. 7 illustrates an embodiment of the invention with a ball-activated sleeve valve for opening the inlet (123) to the tank (10). The ball valve sleeve (126S) may be caught in a ball catcher below if desirable, or remain in place to drive drilling mud circulation via the tank (10) when triggered. This mechanism may be used in context with FIG. 10 or 11.

FIG. 8 is an illustration of an embodiment of the invention with an inverted perforation gun arrangement to open outlets (120) from the tank (10) with swelling agent (5) to be released to the through channel (101). A ball seat displacement trigger mechanism may be used, or electric triggering from a local control and sensor system may be used in an autonomous release system is desired.

FIG. 9 illustrates an embodiment of the invention wherein a slotted inner pipe is used in the tank (10), and the inner pipe's outlets (120) (and/or inlets (123) above the ball seat) are initially blocked by "weak link" plugs (12P). Ball drop and increased pressure may be used to break the weak link plugs.

FIG. 10 is an illustration of a method of the invention wherein a ball dropped and landing and closing a seat in the main bore (101) below the upper inlet (123) to initiate the release of the swelling agent (5) from the outlet (120) to the through bore.

FIG. 11 is an illustration of a similar method of the invention wherein a dart is dropped to the seat and pressure is increased to break the burst discs. Optionally the burst disc of the dart channel is also broken to assure a central flow to dilute the released swelling agent (5) to a desired degree, this may be adjusted by pre-setting inlet and outlet apertures and the aperture in the dart. A mixing of about 1:30 to 1:100 is desirable, and an experiment we conducted used 1:60 for swelling agent (5) to water-based mud ratio.

EMBODIMENTS OF THE INVENTION

Figure 1:
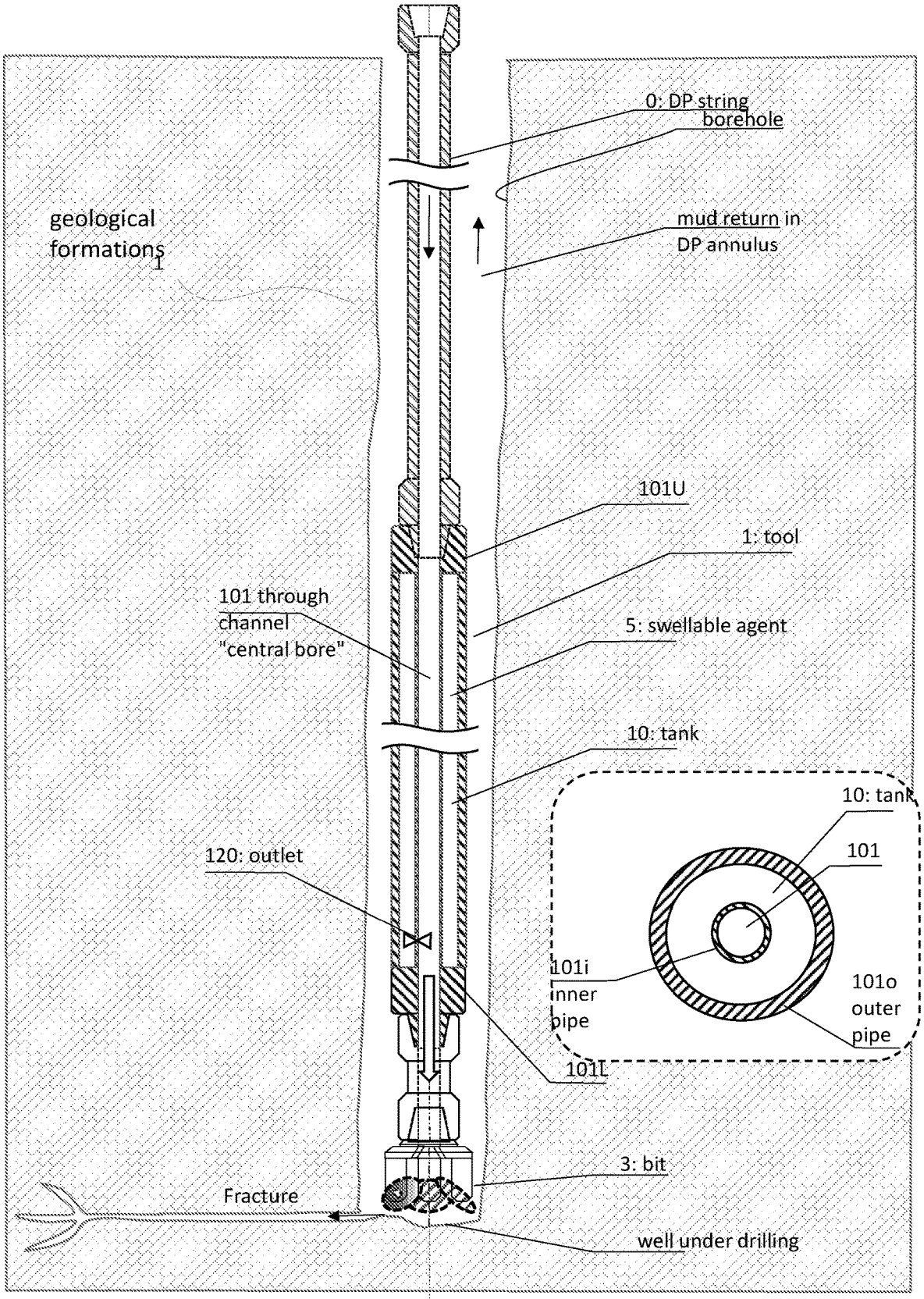
FIG. 1 is an illustration of a general embodiment of the invention with the tool (1) of the invention arranged in a well under drilling and wherein a fracture exists which incurs an undesired mud loss to the fracture. It is also shown a section A-A of the tank (10) which contains the swellable sealing agent (5).

The invention discloses a mud loss treatment drilling tool (1), please see FIGS. 1 and 10, 11,

- Said tool (1) having an upper tooljoint (101U) to be connected to a lower end of an above drill pipe string (0).
- The tool (1) has one or more tank (10) with a through channel (101) for a drilling fluid flow.
- The Tool (1) has a lower tooljoint (101L) connected to a BHA assembly (2, 3) at least comprising a drill bit (3).
  - The tank (10) is arranged for holding a swellable sealant agent (5), e.g. a swellable polymer.
  - The swellable sealant agent (5) is arranged for being released to the drilling mud and for mixing with water (w) which it takes from the drilling mud (or also from formation/fracture water) to swell.

The tank (10) is provided with at least one outlet (120) to said through channel (101) for said swellable sealant agent (5).

The purpose of the invention is that when an undesired mud loss is detected, either automatically or by the driller's observation of the drilling process, for flushing all or part of said swellable sealant agent (5) into said through channel (101), so as for a mixture (5, w) of said swellable agent (5) and said water (w) to start reacting to swell during the time it takes the mixture (5, w) to reach a fracture (f) extending from a well under drilling by said BHA, so as for continuing to swell and block said fracture (f) to stop said undesired mud loss.

In this way, part of the circulating mud is converted to a swellable pill, but the entire process takes place downhole near the drilling bit. In this way, the swelling mixture will reach the cause of undesired mud loss very fast because the swellable agent is stored near the drill bit and the transport path for the mixture is very short to the fracture or loss zone. In an embodiment the proportion is between 1:100 and 1:30, more preferably about 1:60.

An advantage of having a swelling agent which consumes the same water volume downhole as it "expands" to, there is no net volume increase, so the method should work under pressure and under varying pressure.

The sealing agent (5) may be dry, such as powder or small dried flakes or granulate or even extrusion rods, or wet, or wet, in a non-reacting fluid. In an embodiment the "tank" (10) may in an embodiment be a container (10) for push-out extrusion rods of solid swelling agent (5), not fluids. Equivalently, oppositely, the swellable sealant agent (5) arranged for mixing with oil (o) to swell; that would be the same, and is easily developed from this invention.

Figure 2:
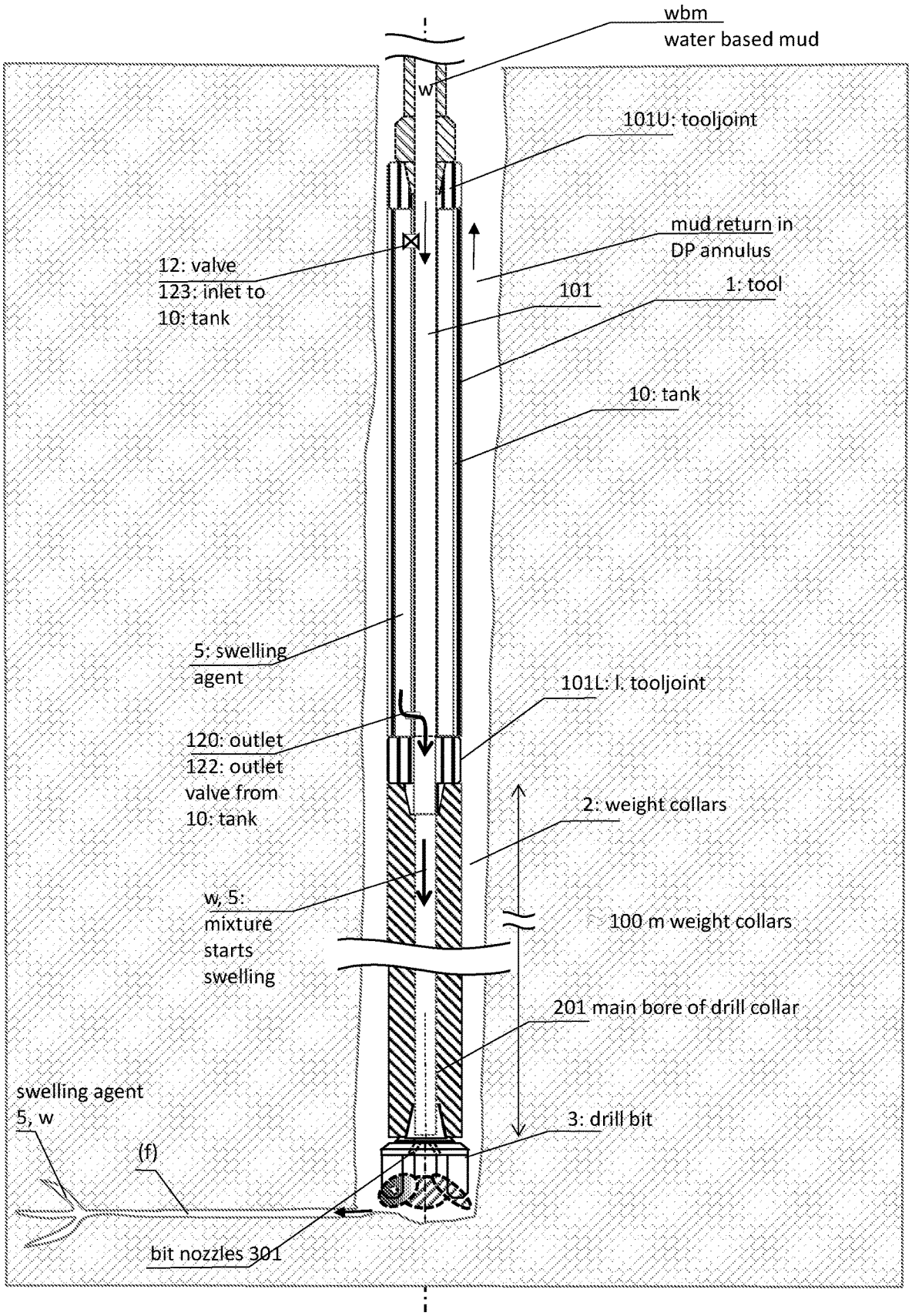
FIG. 2 illustrates an embodiment of the tool (1) with an upper inlet (123) to the tank (10). There is also shown weight collars to load the drill bit.
Figure 3:
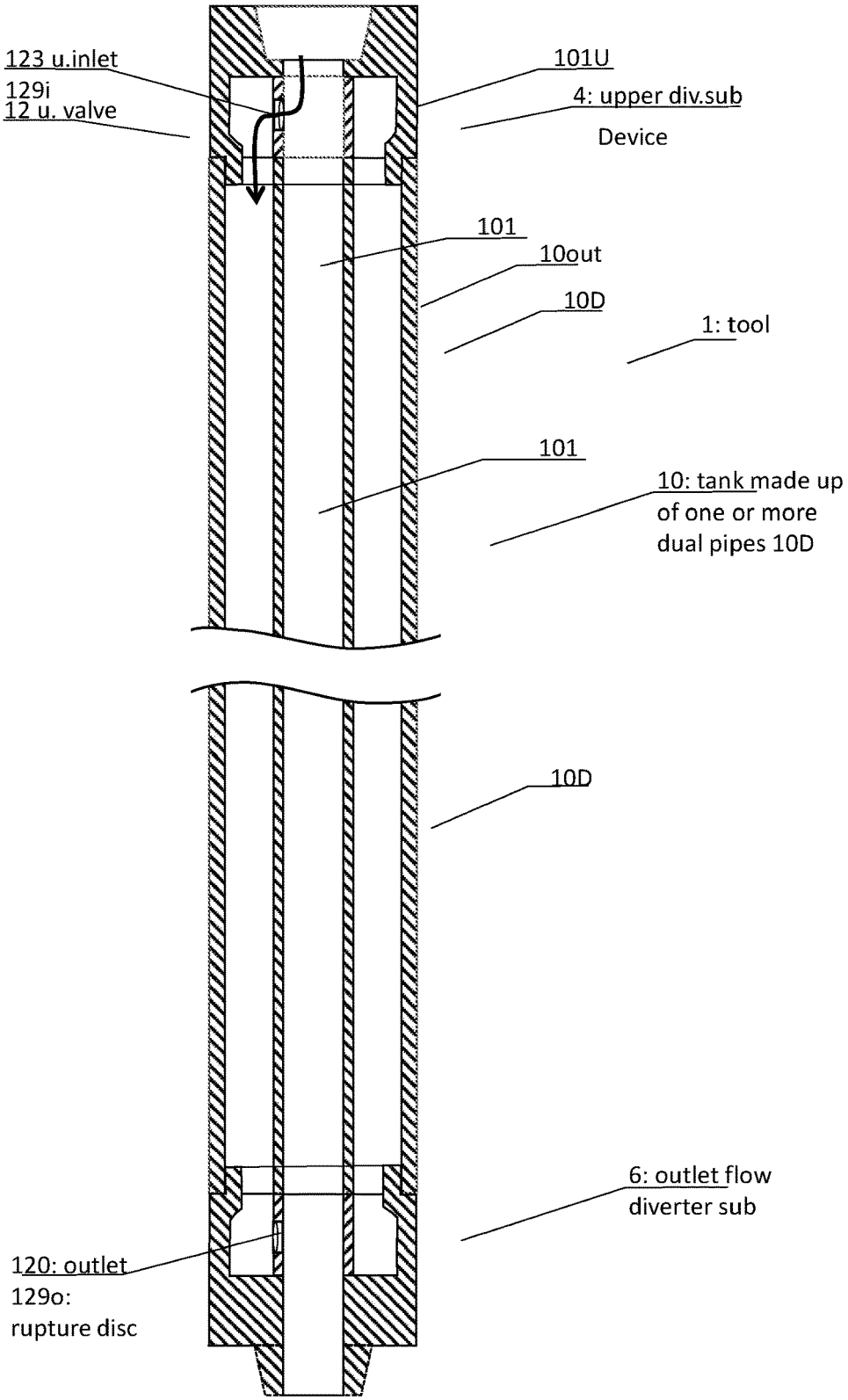
FIG. 3 is an illustration of an embodiment with an upper diverter sub (4) and a lower diverter sub (6), wherein the inlet and outlet are arranged in the diverter subs. In this way more or less standard concentric or "dual" drilling pipe may be utilized.

In an embodiment of the invention, please see FIGS. 2 and 10 and 11, the tool (1), further comprises an inlet (123) from said through channel (101), preferably arranged above said outlet (120) as counted along the tool axis, please see FIG. 2 or FIGS. 10 and 11.

In an embodiment of the invention, the tool's (1) inlet (123) is arranged in an upper, inlet flow diverter sub (4) arranged on top of at least one of said tanks (10), and said inlet flow diverter sub (4) communicating from said through channel (101) via said inlet (123) to said tank (10). This provides displacement mud from the main bore (101) into the tank to displace the swelling agent (5) out of the opposite end through outlet (120). Having the inlet (120) arranged in a separate inlet flow diverter sub (4) makes it easier to assemble the tool (1) form a sub (4) component and one or more dual concentric pipes, and optionally a lower outlet flow diverter sub (6) forming together the tank (10) with a central bore/channel (101).

In an embodiment of the invention the tool (1) has a valve (12) (one or more) for opening the inlet (123) and/or sealing off said through channel (101) above said [lower] outlet (120), please see FIG. 2, 3, 4, (the ball and seat and the burst disc constitute a valve). The inlet (123) may be opened by the same valve (12) if the valve is a ball valve (125) which is arranged at the inlet (123), and redirects the flow, or the valve (12) is arranged below the inlet (123) and the inlet (123) may be opened by an inlet rupture disc (129*i*) in the inlet (123), after e.g. releasing and circulating in a dart or ball to increase the pressure to open the valve.

In an embodiment the tool (1) further comprises said valve (12) being arranged at or below said inlet (123), preferably the inlet (123) is in the upper flow diverter sub (4), for closing said through bore (101) and opening the inlet (123) to the tank (10).

Figure 4:
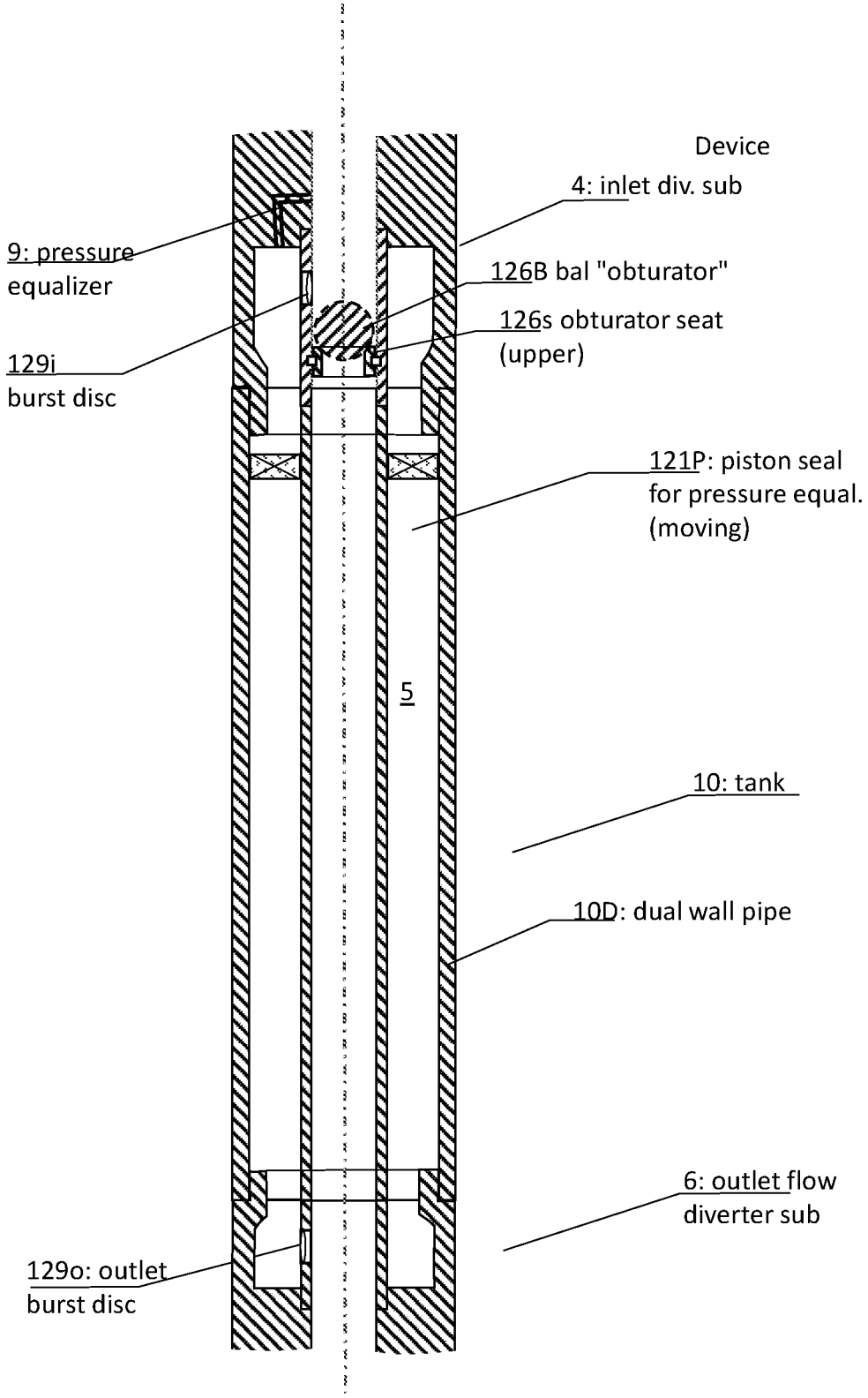
FIG. 4 is an illustration of an embodiment with obturator seat in the inlet diverter sub (4) and a burst disc in the outlet diverter sub (6).

In an embodiment of the invention the tool (1), said valve (12) comprises an obturator seat (126S), see FIG. 4, such as a ball seat or dart seat arranged in said through channel (101) below said inlet (123), and an obturator (126B) such as a ball or a dart, for landing and entirely or partly sealing off said through channel (101).

In an embodiment of the invention the tool (1), wherein said inlet (123) it comprises an inlet rupture disc (129*i*) for sealing off said inlet (123) until a predefined differential pressure across said inlet rupture disc (129*i*) is exceeded.

The tool of the invention may comprise that said outlet (120) is arranged in an outlet flow diverter sub (6) arranged at a lower end of said tank (10), said flow diverter sub (6) communicating between said tank (10) via said outlet (120) to said through channel (101). This makes the assembly easy as one may only need to modify slightly a dual pipe sub being closed in the bottom of the annulus and having a through bore and a lateral port (120) in the inner pipe.

In an embodiment of the invention the tool (1)'s outlet (120) comprises an outlet rupture disc (129*o*) for sealing off said outlet (120) until a predefined differential pressure across the outlet rupture disc (129*o*) is exceeded.

In an embodiment of the invention the tool (1) comprises that said obuturator seat (126S) is part of a sliding sleeve valve (127) arranged in said through channel (101) wherein in a first position (P1) seals off said inlet (123) and when said sliding sleeve valve (127) is sled downhole by a force on said obturator seat (126S) into a second position (P2), said sliding sleeve valve (127) opens up said inlet (123). In an embodiment there is a burst disc at the outlet (120) and a ball operated sleeve valve at the inlet (123)

In an embodiment of the invention, the tool (1) comprises that an outlet obuturator seat (120S) is part of a sliding sleeve valve (120S) arranged in said through channel (101) wherein in a first position (O1) seals off said outlet (120) and when an outlet sliding sleeve valve (120*o*) is sled downhole by a force on said obturator seat (120S) into a second position (O2), said sliding sleeve valve (120*o*) opens up said outlet (120).

The general design of the outlet obturator seat (120S) in the lower part of e.g. FIG. 10 is very similar to what is drawn for the "upper" inlet obturator seat (126S) and its sliding valve, and should be used with a smaller diameter ball than the one above, and be actuated first if there are two. They may be operated independently by a small ball first and larger ball subsequently, and even circulated in with short interval.

In an embodiment of the invention the tool (1) is comprising a ball valve (12, 124) and corresponding seat (preferably shear-out) for sealing off said through bore (101) below said inlet (123) and above said outlet (120), see e.g. FIG. 7 and FIG. 9. The inlet (123) may be opened by the same valve (12) if the ball valve (125) is arranged at the inlet (123), and redirects the flow into the inlet (123).

In an embodiment of the invention the tool (1), said through channel (101) being a through main bore (101) for said drilling fluid flow. Generally in this application the through channel (101) has been drawn axially, but this is no limitation and the through channel (101) may be excentrically arranged (or constituted by a partly plate-like separator structure through the tool such as a longitudinal partition wall between a through passage (101) and a tank (10)).

In an embodiment of the invention said through channel (101) is an axial through main bore (101) such as for dual drilling pipes. The outer wall has the mechanical structure sufficient to be used as drill pipe, the inner pipe shall only withstand the pressure difference between the tank (10) and the central bore (101)

In an embodiment of the invention, we have made an "inverted perforation gun"—release of the swellable sealing agent. Said valve (12) to said outlet (120) comprises one or more perforation charges (12C) arranged along a radially outer face of said central pipe (101*i*) and arranged for forming perforation holes (120C) inwardly radially between said tank (10) and said through channel (101). The perforation charges (12C) are ignited by a trigger mechanism (12Ct) which may comprise a ball seat and shear pin sleeve arranged in said central channel (101) and for being triggered by a ball landing and being pressurized in the ball seat, please see FIG. 8.

In an embodiment of the invention we may use a so-called "slotted apertures central pipe" for the inner pipe wall of the tank. Please see FIG. 9. The valve (12) to said outlet (120) comprises one or more preferably conical slot plugs (12P) made of a weaker material than the pipe wall itself and arranged in corresponding slots (12S) along said central pipe (101*i*) and arranged for forming pressure perforation holes (120S) between said tank (10) and said through channel (101) upon a pressure gradient made across central pipe (101*i*). The plugs, if entering the through channel (101) may be caught in a ball catcher below. Such a ball catcher is shown in FIG. 10 schematically. If conical plugs, some may be arranged for being forced into the tank, and/or arranged for being forced into the central bore (101). There may be arranged a ball seat below at least the upper slot (which may also be an elliptic or circular aperture) so as for creating a pressure differential across the upper slot plugs to break them to pop into the tank, and an opposite pressure differential across the lower slot plugs to make them pop out into the central channel (101). After breaking open the plugs there will be a number of apertures/slots through which the drilling mud will flush out the swellable material (5) through all the perforation-like slots (12S) and mix efficiently into the downward flowing drilling mud and start swelling in the central channel (101).

In an embodiment of the invention, a triggering mechanism constituted by a ball seat ( ) arranged below at least an upper of two or more of said slots (12S) with said slot plugs (12P), so as for a ball or dart or part-open dart (12B) to block said ball seat ( ) to increase pressure above said ball (12B). The partly or entirely blocked ball seat will result in an increasing pressure above it, and will trigger the release. The ball seat may be shearable so as to be caught below in a ball seat catcher. All ball catchers in the present invention have a bypass.

In an embodiment of the invention said tank (10) is annular about said through main bore (101). This is shown in all drawings, and optionally the tank is not annular but constitutes a sector parallel to the through bore which then also becomes a sector passage.

In an embodiment of the invention the tool (1) has arranged below said lower tooljoint (101L) one or more weight collars (2) with main bore (201) and a drill bit (3) forming part of said BHA assembly (2, 3). There may also be an MWD unit between the tool and the drill bit (3).

For drilling in a dominantly vertical direction, one usually has a series of weight collars (2) arranged behind the drill bit in order to have weight on the drill bit during drilling. Drill collars are similar to drill pipe string sections but have a thicker wall in order to provide weight on the bit. The series of weight collars (2) may be about 100 meters all together. These are connected in an upper end to the drill pipe string which is suspended in the drill rig, the drilling motor above the drilling deck. Another purpose of the drill collars is to provide rotational inertia directly connected to the drill bit. So above a neutral point (N) near or in the upper weight collar (2), there generally is axial tension in the drill pipe string which is suspended on the hook, and below the neutral point (N), there is compression in the weight collars (2) acting with an axially downward force on the rotating bit.

In an embodiment of the invention the tool (1) is arranged near above the neutral point (N) of the drill string, i.e. under drill pipe string axial tension or little axial tension, and above the drill weight collars (2). This is an advantage in case of suddenly occurring increased torsion moment resistance during rotational drilling, because the weight collars will have a large rotational inertia to temporarily meet the increased torsion moment resistance, allowing time for reducing the torque applied and/or weight on bit. Otherwise, the relatively thin-walled tank (10) section would directly meet and transfer the torsion moment resistance at the bit, and the main body (1) would risk torsional deformation and damage.

In an embodiment of the invention the tool (1) is arranged without drill weight collars (2) below it (such as illustrated in FIG. 1). Without drill weight collars the tool (1) may be used during drilling in predominantly horizontal wells or strongly deviated wells, as such weight collars increasingly with the deviation angle would lie on the lower wall of the hole being drilled and contribute progressively more moment resistance due to friction of the weight collar on the lower wall. In such a situation there may be no use of weight collars (2) or weight collars may be arranged in a higher level in a more or less vertical section of the drill pipe string, where they may provide a forward push on the bit through the drill pipe string below along the below curving and deviating out borehole path.

In an embodiment of the invention said drill bit (3) has drilling fluid nozzles (301). The swelling of the swelling material (5) absorbing water from the drilling mud while passing from the outlet (120) toward the drill bit should not form so large or solid swollen lumps that they block the drilling fluid nozzles (301) in the bit. This is a task to manage for the chemist manufacturing the swelling agent (5).

In an embodiment of the invention the said upper flow diverter sub (4) comprises said valve (12) arranged for operating with two flow modes;

- a first flow mode (M1) for flow through the through channel (101), with inlet (123) to the tank (10) closed, (please see e.g. FIG. 10*a, b, c*, and *f*, and FIG. 11*a, b, c*, and
- a second flow mode (M2) for flow from the through channel (101) to the inlet (123) to the tank (10) with the through bore (101) below the valve (12) partially or entirely closed, please see FIGS. 10*d, e*, and 11*d, e*.

In an embodiment of the invention, said tank (10) comprises a pressure equalizer mechanism (9) for equalizing a pressure inside the tank (10) with a pressure in the through main channel (101), e.g. in the form a narrow equalizer channel and/or of an annular piston (121P) arranged between said swelling agent (5) in said tank and said through channel (101). This is so as for avoiding inadvertent release of the swelling agent (5) due to pressure differences across a valve or inlet rupture disc (129*i*) on said inlet (123) or said outlet rupture disc (129*o*) sealing off said outlet (120). Please see FIGS. 10 and 11.

In an embodiment of the invention said tank (10) comprises an annulus space (10*ann*) about an inner pipe (10*inn*) and within a concentric outer pipe (10*out*) of a so-called "dual pipe" (10D). This is illustrated in FIG. 4 and some other drawings. Such dual pipes are commercially available. Such dual pipes usually are provided with anchor radial stays to hold the inner pipe centrically within the outer pipe. This means that an annular separator piston in the tank (10) could not pass such radial anchor stays. However we could use a single-length dual pipe section with only stays at either ends in combination with a annular separator piston in order to avoid mixing of incoming water mud and swelling agent (5).

In an embodiment of the invention there is arranged aid upper diverter sub (4) [with or without an inlet (123)], arranged on top of one or more said dual pipes (10D) further arranged on said lower diverter sub (6) with said outlet (120). A big advantage of this embodiment is that only the diverter subs (4, 6) have to be custom built.

In an embodiment the lower outlet (120) is provided with a lower valve (122). Please see FIG. 10. (We consider a rupture disc to be a valve which can be opened once.)

In an embodiment of the invention said lower valve (122) comprises a ball seat sliding sleeve (122S) for an obturator (122B) (ball or dart), please see FIG. 7. The sliding sleeve comprises shear pins in order to break at a given pressure.

The tool is in an embodiment obturator-controlled. In an embodiment of the invention the tool (1) is alternatively, or supplementary, further comprising:

- a downhole control system (13) with an algorithm (131) (not shown) for determining whether an undesired mud loss state is occurring, and
- a sensor system (11) providing, while drilling, one or more measurements (m1, m2) to said control system (13), wherein said control system (13) is arranged to command said lower outlet (120) to be opened and release said swellable sealant agent (5) to a well under drilling by said BHA assembly (2, 3), if an undesired mud loss state is occurring. Then everything may be measured and controlled downhole and a motor (see FIG. 6) may open a ball valve to eventually release the swelling agent (5) to the main bore while the drilling mud flushes it out to the fracture causing the lost circulation.

In a further embodiment the invention comprises:

- a communication unit, for receiving commands from surface, wherein said communication unit upon receiving an command from surface is arranged to operate said flow diverter for redirecting said flow to release said swellable sealant agent (5) to a well under drilling by said BHA assembly (2, 3), if an undesired mud loss state is occurring. The communication may take place via wired pipe or pulse telemetry.

The commands from surface are sent from an operator on the surface such as the driller as an response to indications of lost circulation.

Alternatively the commands from surface is sent from an surface control system with an algorithm for determining whether an undesired mud loss state is occurring. The downhole tool (1) may transmit to the surface simply that a loss of mud is detected, and wait for a confirmation to release the swelling agent (5), or act without confirmation.

Figure 5:
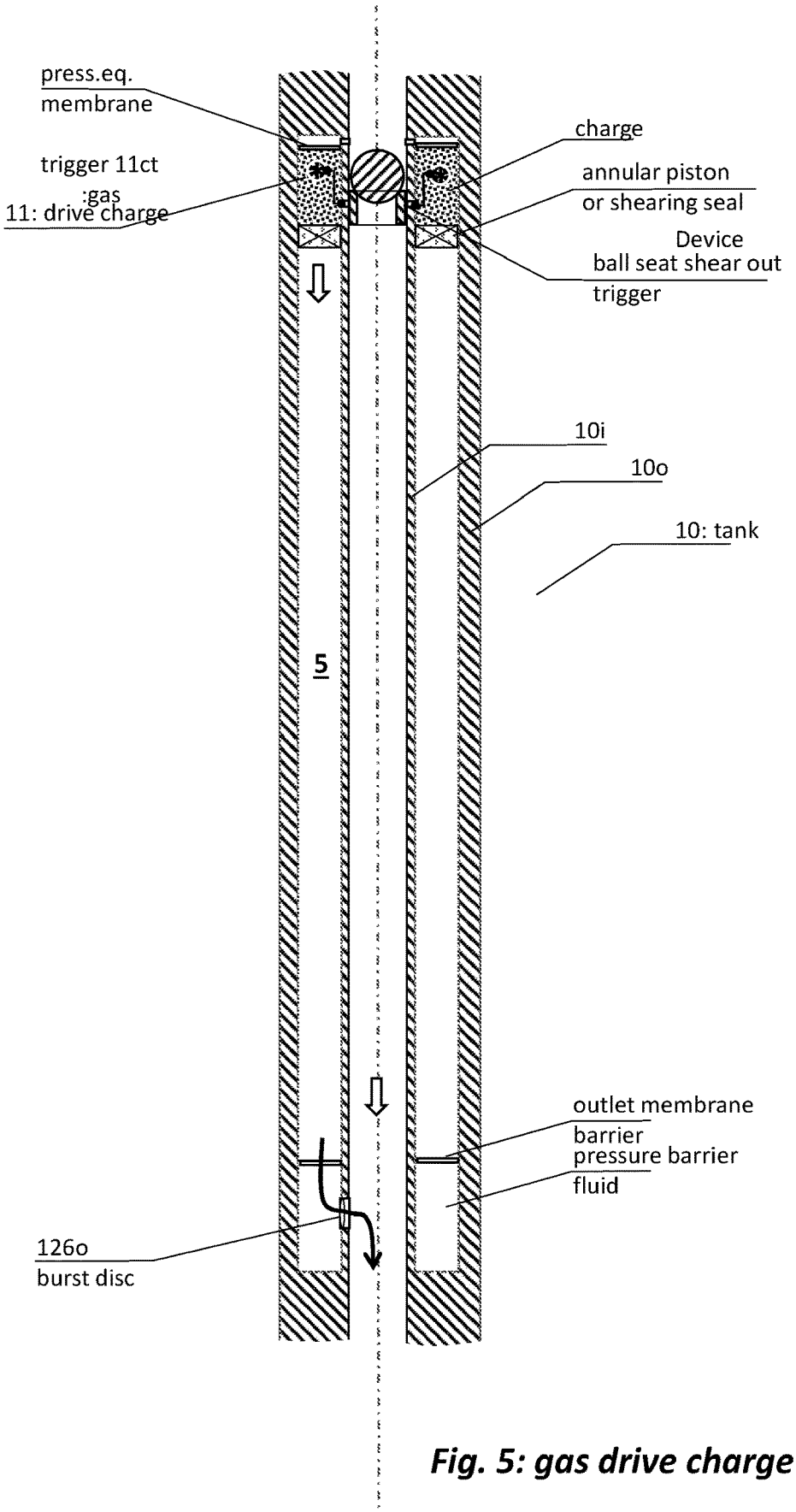
FIG. 5 is an illustration of an embodiment with a high pressure gas generating charge arranged to drive out the remedial swelling agent (5) through the lower aperture (120) through a burst disc (126*o*). Also here we may use upper and lower diverter subs.

In an embodiment of the invention a slow reacting pressure generating explosive charge in upper part of the tank (10)—release of the swellable sealing agent. is used. A slow combusting or slow reacting gas pressure generating charge (11) is arranged in an end portion of said tank (10) and arranged for breaking a rupture barrier (or move a piston) to said swellable matter (5) and force said swellable matter towards said outlet (120) which may comprise a rupture disc. There may be a narrow-channel and spacer buffered pressure equalizer mechanism behind the charge (11) so as for compensating for slow pressure variations relative to the tank (10) in the well. Please See FIG. 5.

In an embodiment of the invention said charge (11) is ignited by a trigger mechanism (11Ct) comprising a ball seat and shear pin sleeve arranged in said central channel (101) and for being triggered by a ball landing and being pressurized in the ball seat.

| | | |
|---|---|---|
| 0 | drill pipe string (0) above upper tooljoint (101U) | |
| 1 | mud loss drilling tool | |
| 101U | upper tooljoint | |
| 101L | lower tooljoint | |
| 10 | tank with through channel (101) | |
| 101 | through channel for drilling fluid flow | |
| 5 | swellable agent | |
| 120 | outlet from tank (10) to through channel (101) | |
| 123 | inlet from through channel (101), above outlet(120) | |
| 4 | inlet flow diverter sub on top of one of tanks (10) | communicating from through channel (101) via inlet (123) to the tank (10) |
| 12 | valve (12) for opening inlet (123) or sealing off through channel (101) | |
| 126s | obturator seat, ball or dart seat, arranged in through channel (101) below inlet (123) | |
| 126B | obturator such as ball or dart, for seat (126S) | |
| 129i | rupture disc for sealing off inlet 123 | |
| 6 | outlet flow diverter sub with said outlet (120) | communicating between tank (10) via outlet (120) to through channel (101). |
| 129o | outlet rupture disc in outlet (120) | |
| 127 | sliding sleeve valve in through channel (101) with ouburator seat (126s) | first pos (P1) seals off inlet (123), second pos (P2) opens inlet (123). |
| 124 | ball valve in said bore (101), arranged below inlet (123) and above outlet (120) | |

-continued

| | | |
|---|---|---|
| 12C | perforation charges | |
| 101i | central pipe in said central tank (10). | |
| 120C | perforatino holes shot between tank (10) and through channel (101) | |
| 12P | conical slot plugs | |
| 201 | main bore of drill weight collars (2) | |
| 3 | drill bit | |
| 301 | nozzles in drill bit | |
| 10D | dual pipe of said tank (10) | |
| 122 | lower valve | |
| 13 | downhole control system with algorithm (131) | determining whether undersired mud loss state is occurring |
| 11 | sensor system prividing measurements (m1, m2) to control system (13). | |

The invention claimed is:

1. A mud loss treatment drilling tool comprising:

said tool having an upper tool joint to a lower end of an above drill pipe string;

one or more tanks with a through channel for a drilling fluid flow;

a lower tool joint connected to a bottom hole assembly (BHA) at least comprising a drill bit;

said tank arranged for holding a swellable sealant agent;

said swellable sealant agent arranged for mixing with water to swell;

said tank provided with an outlet to said through channel for said swellable sealant agent;

an inlet from said through channel, arranged above said outlet as counted along the tool axis; and said inlet arranged in an upper, inlet flow diverter sub arranged on top of at least one of said tanks, said inlet flow diverter sub communicating from said through channel via said inlet to said tank, so as for, when an undesired mud loss is detected, flushing all or part of said swellable sealant agent into said through channel, so as for a mixture of said swellable agent and said water to start reacting to swell during the time it takes the mixture to reach a fracture extending from a well under drilling by said BHA, so as for continuing to swell and block said fracture to stop said undesired mud loss.

2. The tool of claim 1, further comprising a valve arranged for opening the inlet and/or sealing off said through channel above said outlet.

3. The tool of claim 2, wherein said valve is arranged at or below said inlet and arranged for closing said through bore and opening the inlet to the tank.

4. The tool of claim 3, wherein the inlet is in the upper flow diverter sub.

5. The tool according to claim 1, wherein said valve further comprises:

an obturator seat, a ball seat or dart seat, arranged in said through channel below said inlet; and an obturator, a ball or a dart, for landing and entirely or partly sealing off said through channel.

6. The tool of claim 1, wherein said inlet further comprises an inlet rupture disc for sealing off said inlet until a predefined differential pressure across said inlet rupture disc is exceeded.

7. The tool of claim 1, further comprising an outlet flow diverter sub wherein said outlet is arranged, said flow diverter sub arranged at a lower end of said tank, said flow diverter sub communicating between said tank via said outlet to said through channel.

8. The tool of claim 1, wherein said outlet further comprises an outlet rupture disc for sealing off said outlet until a predefined differential pressure across the outlet rupture disc is exceeded.

9. The tool according to claim 5, further comprising a sliding sleeve valve arranged in said through channel, wherein said obuturator seat is part of said sliding sleeve valve arranged in said through channel wherein in a first position seals off said inlet and when said sliding sleeve valve is sled downhole by a force on said obturator seat into a second position, said sliding sleeve valve opens up said inlet.

10. The tool according to claim 1, wherein an outlet obuturator seat is part of a sliding sleeve valve arranged in said through channel wherein in a first position seals off said outlet and when an outlet sliding sleeve valve is sled downhole by a force on said obturator seat into a second position, said sliding sleeve valve opens up said outlet.

11. The tool of claim 1, further comprising a ball valve for sealing off said through bore below said inlet and above said outlet.

12. The tool of claim 1, wherein said through channel being a through main bore for said drilling fluid flow.

13. The tool of claim 12, wherein said through channel being an axial through main bore.

14. The tool of claim 1, further comprising a central pipe in said tank, said central pipe forming said through channel.

15. The tool of claim 1, wherein said valve to said outlet further comprises one or more perforation charges arranged along a radially outer face of said central pipe and arranged for forming perforation holes between said tank and said through channel.

16. The tool of claim 15, said perforation charges ignited by a trigger mechanism comprising a ball seat and shear pin sleeve arranged in said central channel and for being triggered by a ball landing and being pressurized in the ball seat.

17. The tool of claim 1, wherein said valve to said outlet further comprises one or more conical slot plugs arranged in corresponding slots along said central pipe and arranged for forming pressure perforation holes between said tank and said through channel upon a pressure gradient made across central pipe.

18. The tool of claim 17, a triggering mechanism constituted by a ball seat arranged below at least an upper of two or more of said slots with said slot plugs, so as for a ball or dart or part-open dart to block said ball seat to increase pressure above said ball.

19. The tool of claim 1, said tank being annular about said through main bore.

20. The tool of claim 1, wherein said tool further comprises one or more weight collars arranged below said lower tool joint, said one or more weight collars with main bore and a drill bit forming part of said BHA assembly.

21. The tool of claim 1, wherein said drill bit has drilling fluid nozzles.

22. The tool according to claim 1, wherein said upper flow diverter sub further comprises said valve arranged for operating with two flow modes:

a first flow mode for flow through the through channel, with inlet to the tank closed; and a second flow mode for flow from the through channel to the inlet to the tank with the through bore below the valve partially or entirely closed.

23. The tool according to claim 1, wherein said tank comprises a pressure equalizer mechanism for equalizing a pressure inside the tank with a pressure in the through main channel.

24. The tool according to claim 23, wherein said pressure equalizer mechanism comprises a narrow equalizer channel and/or of an annular piston arranged between said swelling agent in said tank and said through channel.

25. The tool of claim 1, wherein said tank further comprises an annulus space about said inner pipe and within a concentric outer pipe.

26. The tool of claim 25, wherein said upper diverter sub with said inlet, is arranged on top of one or more of said tanks further arranged on said lower diverter sub with said outlet.

27. The tool of claim 1, further comprising said lower outlet provided with a lower valve.

28. The tool of claim 27, wherein said lower valve further comprises a ball seat sliding sleeve for an obturator (ball or dart).

29. The tool of claim 1, further comprising a communication unit for receiving commands from surface, wherein said communication unit upon receiving a command from surface is arranged to operate said flow diverter sub for redirecting said flow to release said swellable sealant agent to a well under drilling by said BHA assembly, if an undesired mud loss state is occurring.

30. The tool of claim 29, wherein the commands from surface is sent from an operator on the surface as an response to indications of lost circulation.

31. A method for curing mud loss in a well being drilled, comprising the following steps:

assembling the mud loss treatment drilling tool according to claim 1, by the steps of:

assembling said upper tool joint suitable for connecting to a lower end of an above drill pipe string, said upper tool joint comprising an inlet arranged in said upper, inlet flow diverter sub arranged on top of said at least one of one or more tanks with a through channel, said inlet flow diverter sub communicating from said through channel via said inlet to said tank;

assembling said one or more tanks with said through channel suitable for conveying a drilling fluid flow;

providing said tank with said outlet to said through channel;

assembling said lower tool joint suitable for connecting to a BHA assembly at least comprising a drill bit; and filling said one or more tanks with said swellable sealant agent suitable to be mixed with water to swell;

conveying said mud loss treatment drilling tool into the well on the drill pipe string together with said BHA assembly;

monitoring for an undesired mud loss state in the well while drilling;

if detecting such an undesired mud loss state, releasing the swelling agent from the tank to the through channel to mix with water present in the drilling mud to start swelling; and allowing the swelling agent to travel out via the through channel and through the drill bit and into cracks in the formation surrounding the well to continue swelling and curing said undesirable mud loss.

32. The method of claim 31, further comprising the steps of:

upon detecting said undesired mud loss state, dropping an obturator;

landing said obturator in an obturator seat in the through channel of the mud loss treatment drilling tool, thus blocking said through channel; and redirecting the drilling fluid flow into said inlet for flushing out said swellable sealing agent from the tank and out into the through bore through said outlet.

33. The method of claim 31, further comprising the steps of:

dropping a first obturator;

landing said first obturator in a first obturator seat in the through bore of the mud loss treatment drilling tool;

shifting a sleeve valve to open the outlet;

shearing out said first obturator seat;

catching said first obturator in a catcher;

dropping a second, larger obturator;

landing said second obturator in a second obturator seat in the through bore of the mud loss treatment drilling tool above the first obturator seat to close of said through bore;

shifting a second sleeve valve to open up said inlet; and redirecting the drilling fluid flow into said inlet for flushing out said swellable sealing agent from the tank and into the through bore through said outlet.

34. The method of claim 31, further comprising the steps of:

providing said outlet with a burst disk and said inlet with a burst disk;

bursting said burst disks in the inlet by increasing pressure in the through bore; and bursting said burst disk in the outlet by increasing the pressure in said tank via said inlet.

35. The method of claim 31, further comprising the steps of:

providing said obturator with a through bore;

providing said through bore in said obturator with a burst disk; and bursting said burst disk in said through bore in said obturator, opening up a drilling fluid flow area through said obturator.

* * * * *